US006123999A

United States Patent [19]

Felix et al.

[11] Patent Number: 6,123,999

[45] **Date of Patent: *Sep. 26, 2000**

[54] WEAR RESISTANT NON-STICK RESIN COATED SUBSTRATES

[75] Inventors: Vinci Martinez Felix, Kennett Square; Pidatala Krishna Mohan, West Chester; William Francis McHale, Oxford, all of Pa.

[73] Assignee: E. I. du Pont de Nemours and Company, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/042,778

[22] Filed: Mar. 17, 1998

Related U.S. Application Data

[60] Provisional application No. 60/040,868, Mar. 21, 1997.

[51] Int. Cl.[7] ..... C23C 4/06; C23C 4/12

[52] U.S. Cl. ..... 427/449; 427/452; 427/456

[58] Field of Search ..... 427/456, 447, 427/449, 452

[56] References Cited

U.S. PATENT DOCUMENTS

| | | | |
|---|---|---|---|
| 3,419,414 | 12/1968 | Marks | 117/70 |
| 4,028,339 | 6/1977 | Merrill | 260/46.5 R |
| 4,087,394 | 5/1978 | Concannon | 260/29.6 F |
| 4,118,537 | 10/1978 | Vary et al. | 428/422 |
| 4,123,401 | 10/1978 | Berghmans et al. | 260/29.6 F |
| 4,180,609 | 12/1979 | Vassiliou | 428/212 |
| 4,196,256 | 4/1980 | Eddy et al. | 428/422 |
| 4,259,375 | 3/1981 | Vassiliou | 427/267 |
| 4,262,043 | 4/1981 | Wald | 427/387 |
| 4,351,882 | 9/1982 | Concannon | 428/422 |
| 4,443,574 | 4/1984 | Coq et al. | 524/423 |
| 4,477,517 | 10/1984 | Rummel | 428/324 |
| 5,069,937 | 12/1991 | Wall | 427/227 |
| 5,230,961 | 7/1993 | Tannenbaum | 428/422 |
| 5,240,775 | 8/1993 | Tannenbaum | 428/422 |
| 5,250,356 | 10/1993 | Batzar | 428/421 |
| 5,411,771 | 5/1995 | Tsai | 427/238 |
| 5,455,102 | 10/1995 | Tsai | 428/141 |
| 5,462,769 | 10/1995 | Tsai | 427/307 |
| 5,562,991 | 10/1996 | Tannenbaum | 428/421 |
| 5,827,573 | 10/1998 | Tsai | 427/357 |

FOREIGN PATENT DOCUMENTS

| | | |
|---|---|---|
| 0 104 655 | 4/1984 | European Pat. Off. . |
| 0 206 121 B1 | 6/1986 | European Pat. Off. . |
| 0 365 485 B1 | 10/1989 | European Pat. Off. . |
| 0 568 322 A2 | 4/1993 | European Pat. Off. . |
| 0 594 374 A1 | 10/1993 | European Pat. Off. . |
| 0 568 322 A2 | 11/1993 | European Pat. Off. . |
| 0 595 601 A1 | 5/1994 | European Pat. Off. . |
| 1012688 | 12/1965 | United Kingdom . |
| 2 111 861 | 11/1982 | United Kingdom . |
| 2 225 728 | 5/1992 | United Kingdom . |
| 2 255 728 | 11/1992 | United Kingdom . |
| 2 277 466 | 11/1994 | United Kingdom . |

*Primary Examiner*—Katherine A. Bareford
*Attorney, Agent, or Firm*—Thomas W Steinberg

[57] ABSTRACT

A method for preparing a scratch and abrasion resistant surface on unroughened aluminum or stainless steel cookware, for subsequent coating with a nonstick polymer resin, such as a fluoropolymer, in a liquid and/or powder medium. The scratch and abrasion resistant surface consists of a thermally sprayed aluminum or stainless steel, respectively. A metal coated substrate produced by this method and an article subsequently coated with a fluoropolymer surface by this method are also described.

22 Claims, 2 Drawing Sheets

WEAR RESISTANT NON-STICK RESIN COATED SUBSTRATES

RELATION TO OTHER APPLICATIONS

This application claims the benefit of provisional application Ser. No. 60/040,868, filed Mar. 21, 1997.

FIELD OF THE INVENTION

This invention relates to methods for applying scratch and abrasion resistant metallic layers to substrates and subsequently applying nonstick coatings. Substrates prepared in this way produce nonstick surfaces with substantially longer service life.

BACKGROUND OF THE INVENTION

It has long been desirable to achieve longer wearing non-stick resin coatings on metal substrates. U.S. Pat. No 5,411,771 (Tsai) discloses electric arc spraying at 100–300 amps current and air pressure of 5–8 kg/cm$^2$ metallic materials including copper, zinc, nickel, chromium, aluminum, carbon steel and other stainless steels onto a metal substrate which is made of iron, steel, copper or aluminum to form a mechanically resistant layer on the substrate, with the result that the 23–36 micrometer thick polytetrafluoroethylene (PTFE) non-stick layer applied to the mechanically resistant layer has a pencil hardness of 8–9 H, which is disclosed to make the non-stick layer abrasion resistant. The patent discloses the preference for a stainless steel substrate and low carbon stainless steel as the metal wire for arc spraying to form the mechanically resistant layer. U.S. Pat. No. 5,462,769 (Tsai) improves upon the '771 patent by forming the non-stick coating of PTFE/perfluoroalkoxy polymer (PFA) to eliminate rusting of the cooking surface. Both patents require the metal substrate, prior to the metal spraying step which formed the mechanically resistant layer, to be roughened, and in particular, use aluminum oxide particles blasted against the substrate surface to create a surface roughness of Ra 4.5–5.5 micrometers (177–217 microinches). The mechanically resistant layer formed on this roughened surface has a generally greater roughness of 5–8 micrometers (197–315 microinches), leading to the non-stick layer having a roughness of 2.5–5.5 micrometers (98–217 microinches).

One disadvantage of the process of these patents is the requirement for blasting the substrate surface to roughen prior to metal spray coating. Such blasting is a difficult, costly and environmentally unfriendly process in a manufacturing operation, especially cookware manufacturing, because of the:

- high consumption of compressed air;
- effect of abrasive airborne dust on rotating machine parts in the surrounding areas, leading to increased maintenance costs;
- elevated noise levels in the area surrounding the grit blasting operation, requiring hearing protection for operating personnel; and
- potential process bottleneck resulting from grit blasting machine maintenance requiring downstream shutdown.

In U.S. Pat. No. 5,069,937 (Wall) discloses that aluminum is not a good substrate for spraying with molten metal because of the formation of aluminum oxide within the coating layer, which becomes noticeable as "white rust" corrosion. Wall claims to have solved this problem by using a particular stainless steel as the molten metal, namely that which contains 25 to 35 wt % chromium, 8 to 15 wt % nickel, with most of the remainder being iron. Wall also roughens his substrate before spraying with the molten metal, the roughening forming peaks and valleys, with the distance from peak to valley being 15 to 20 micrometers (591–787 microinches). This extreme roughening is made even rougher by the molten metal droplets forming particles on the substrate surface of 25 to 50 micrometers (984–1969 microinches) in diameter.

Beside having the disadvantage of requiring roughening of the substrate, this teaching has additional disadvantages. The depth of roughening (valleys) is not reliably, on a production basis, completely fillable with fluorocarbon polymer layer, even when applied as a liquid dispersion, leaving small air pockets between the depth of the valleys and the underside of the polymer non-stick coating. Eventually, this air and other gas permeating through the coating expands under heating to cause the coating to separate from the sprayed coating on the substrate, representing a failure of the non-stick coating. Another disadvantage arises from the application of stainless steel of varying nickel and chromium compositions on aluminum causing corrosion of the metal substrate. This corrosion arises when such substrates are exposed to electrolytic environments, such as tomato sauces, commercial powder dish washing detergents and the like, the metallurgical phenomenon of galvanic (bimetallic) corrosion causes accelerated corrosion of the aluminum substrate. This corrosion causes blistering of the nonstick coating, leading to loss of release and failure. Such corrosion has been observed even with stainless steel alloys of high chromium and increased nickel content as described by Wall.

SUMMARY OF THE INVENTION

The present invention provides a new method for preparing a metal substrate by applying a thermally sprayed metal layer to a metal substrate, e.g., a cooking vessel, before nonstick coating application, without the need to first roughen, e.g. grit blast, the substrate and without creating the environment for galvanic corrosion. That is, in accordance with the present invention, the metal substrate and sprayed metal layer are galvanically compatible. Thus, the present invention has found a way for adhering the metal coating onto unroughened metal substrates and without sacrificing the improved durability of the nonstick polymer resin overcoat by undesirable interaction between the metal layer and either the metal substrate or resin overcoat, even when the substrate is aluminum.

Specifically the present invention provides a method of preparing a surface of an aluminum or stainless steel substrate for the subsequent coating with a nonstick polymer resin by applying onto the surface, which is unroughened, a metallic layer by thermal spraying aluminum containing up to 50% by weight of silicon when the surface of the substrate is aluminum and stainless steel when the surface of the substrate is stainless steel. Further provided is a metal-coated unroughened substrate with a coating on said substrate surface formed by thermal spraying a metal, the metal and the substrate having the identities just described.

The term "unroughened" means that the substrate is not grit blasted. The surface of the substrate is therefore smooth in the sense that it has the surface imparted to it by the fabrication method used to form the substrate, i.e. (i) article stamped from sheet rolled from a metal ingot or (ii) cast article such as cookware from a mold.

The thermally sprayed metal layer on the unroughened substrate, however, provides a roughened surface for excellent adhesion of the nonstick resin coating onto the metal layer. The method of the present invention provides the ability to control the degree of roughness (surface profile) of the metal layer, so the deep valleys, impenetrable by the resin overcoat, is avoided. The combination of the metallized layer and intimate contact between this layer and the underside of the nonstick polymer resin overcoat and galvanic compatibility between the metal layer and the metal of the substrate provides increased wear (life) to the nonstick coating and enables it to be used with metal cooking utensils, e.g. spatula, whisk, fork, and even knives, to resist scratching, scraping, and cutting.

In one embodiment of the method of the present invention, spray conditions are used which have not heretofore been used to coat even roughened surfaces of cookware, which is required for applying the coating to unroughened substrate surfaces on a production line basis. In a another embodiment, the metal substrate and the metal used for thermal spray application to form the metal layer on the substrate are both made of aluminum. Suprisingly, the process can be carried without the formation of aluminum oxide which would prevent adhesion between the molten droplets of aluminum and the unroughened substrate. This is particularly surprising when the spray of molten aluminum droplets is formed or directed by pressurized air, such as in the case of electric arc spraying, onto the aluminum substrate. Instead of forming a skin of aluminum oxide on the droplet surfaces or causing oxidation of the aluminum substrate, which would interfere with adhesion between the droplets and the substrate, the method of the present invention provides tenacious adhesion of the droplets and the layer formed thereby on the unroughened aluminum substrate. The tenacity of this adhesion can be easily tested by scraping a knife blade across the metal layer surface under a hand pressure that would leave a scrape mark in the uncoated substrate, with the presence of the adhered layer preventing any scrape mark from occurring. The absence of aluminum oxide on the substrate surface is also easily seen by merely touching the metal-sprayed substrate surface with a finger; no powder mark should appear on the finger, which powder would be aluminum oxide. The method of the present invention provides controlled roughening of unroughened metal surfaces of aluminum and other metals which protect the substrate surface from the scraping test described above and which in the case of oxidizable metals applied in molten spray droplets, such as aluminum, oxidation of the metal droplets which would prevent adhesion to the substrate does not occur.

In another embodiment, the invention provides a method of preparing a surface of an aluminum or stainless steel substrate for the subsequent coating with a nonstick polymer resin by applying onto the surface, which is unroughened, a thermally sprayed galvanically compatible metallic layer (aluminum on aluminum substrate and stainless steel on stainless steel substrate) and subsequently applying a thermally sprayed powder layer of ceramic or metal which is galvanically compatible with the metallic layer and the substrate. Further provided is a coated unroughened aluminum or stainless steel substrate having a galvanically compatible metal coating of aluminum containing up to 50 wt % of Si or stainless steel, respectively, on said substrate surface formed by thermal spraying such metal onto said substrate and a thermally sprayed powder layer of ceramic or metal which is galvanically compatible with the metallic layer and the substrate.

DETAILED DESCRIPTION

Figure 1:
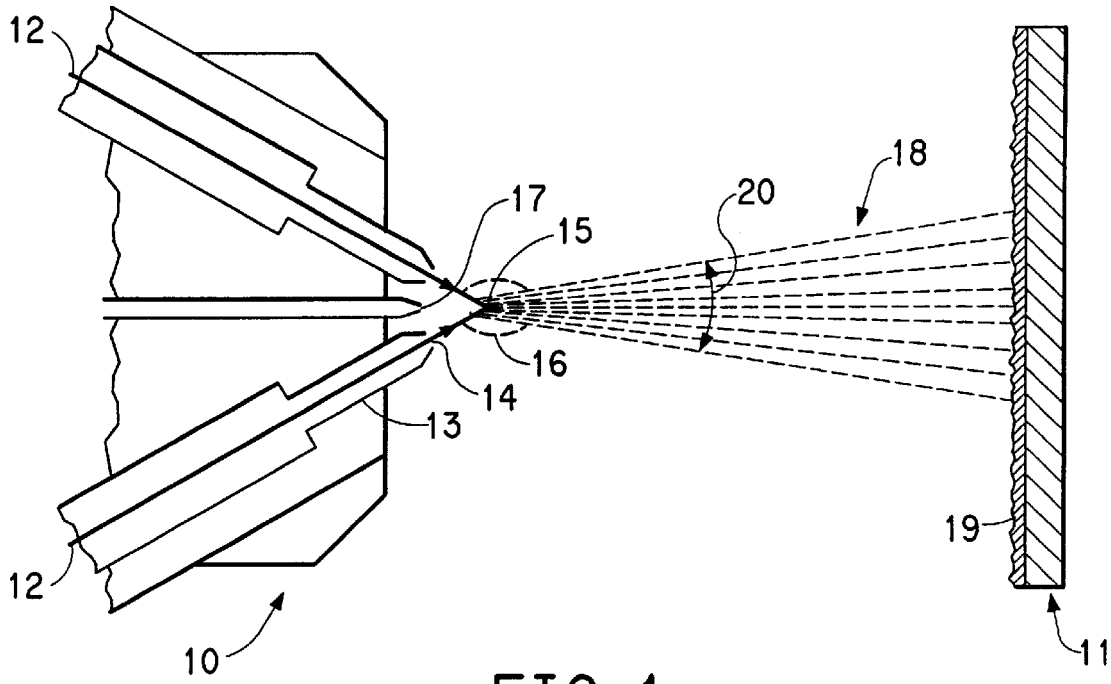
FIG. 1 is a schematic of a typical electric arc spray gun and a metal substrate being sprayed.

The present invention for preparing the surface of a substrate to receive a nonstick polymer coatings having increased wear resistance is applicable to aluminum and stainless steel substrates (substrate surfaces). Substrates such as stamped aluminum, cast aluminum, stainless steel, steel and aluminized steel, all can benefit by use of this invention. Stamped discs, coils, sheets etc. used in bakeware, casseroles and top-of-the-range cookware are all suitable substrates. The inside cooking surfaces of preformed (cast) cookware, preferably made from aluminum, are also suitable substrates. Aluminum substrates, i.e. surfaces made of aluminum, are preferred because of their widespread utility with non-stick surfaces and the failure of the prior art to provide metallized coatings on aluminum by thermal spraying, without the accompanying disadvantages of grit-blast pretreatment of the aluminum and creating the environment for galvanic corrosion. The aluminum substrate includes such varieties as 3003 which is alloyed with small amounts of other metals, notably 0.6 wt % Si, 0.05–0.2 wt % Cu, and 1.0–1.5 wt % Mg and 3004 which contain, 0.3 wt % Si, 1.0–1.5 wt % Mn, and 0.8–1.3 wt % Mg. Other aluminum alloys can also be used such as 1350 (0.10 wt % Si), 1050 (0.25 wt % Si), 4043 (4.5–6.0 wt % Si), 4543 (5.0–7.0 wt % Si), 4032 (11.0–13.5 wt % Si), and 4047 which contains a similar amount of Si. These alloys are rolled into sheet from an ingot and then fabricated such as by stamping into the shape desired, such as cookware. Cast aluminum substrates can also be used, the cast aluminum typically containing 4.5 to 23.0 wt % Si, with alloy 413.0 being the most commonly used, containing 11.0–13.0 wt % Si. These alloys of aluminum are cast into the shape desired, such as cookware.

Examples of stainless steels which are used for the unroughened substrates include the following alloys (with iron): 304–18.0–20.0 wt % Cr and 8.0–10.5 wt % Ni; 305–17.0–19.0 wt % Cr and 10.5–13.0 wt % Ni, 309–22.0–24.0 wt % Cr and 12.0–15.0 wt % Ni, 316–16.0–18.0 wt % Cr and 10.0–14.0 wt % Ni, and 317–18.0–20.0 wt % Cr and 11.0–15.0 wt % Ni. Any number of a wide variety of stainless steel alloys may be selected for this invention. The preferred stainless steel is the austenitic type, i.e., containing up to 30 wt % Cr and 40 wt % Ni. More preferably the stainless steel contains 15–30 wt % Cr and at least 1 wt % Ni, most preferably 10–25 wt % Ni.

The surface of the metal substrate to receive the molten metal droplets for metal coating is unroughened, i.e. smooth, although some degree of topography may be cast into the cast substrate surface, e.g. concentric rings to aid in heat distribution during use of the cookware. Even then, the substrate is unroughened (no grit blasting), and the surface of the cast-in topography is smooth.

The smooth substrate is treated only by caustic washing or air blasting or the like to provide a clean surface, i.e. to remove grease and other debris or contaminants which might interfere with adhesion of the sprayed metal coating. The profile of the substrate is measured in average microinches using a Hommel model T-500 surface roughness tester made by Hommel of New Britain, Conn. The profile on typical rolled aluminum after washing to remove grease and contaminants is 16–24 microinches (0.41–0.61 microns). The profile on cast aluminum which exhibits a shiny surface has nevertheless a considerably greater surface profile, e.g., 100 to 175 microinches (2.5 to 4.375 micrometers). The shiny appearance of the cast aluminum surface is deceiving as to smoothness; although the shine comes from very low profile regions which appear to dominate the cast aluminum surface, there are sufficient surface pits to give a high surface profile in the profile measurement procedure. The method of the present invention provides adhesion even to such a shiny surface without requiring any roughening after the casting operation. The profile on steel varies more widely but is typically less than 50 microinches (1.25 micrometers). Typical prior art methods have used techniques such as grit blasting to roughen steel and aluminum to profiles of much greater than 100 microinches (2.5 micrometers), e.g. the Tsai patents disclose a minimum roughness of 180 microinches (4.5 micrometers) prior to applying the metal layer, and preferably for aluminum for some uses to 180–220 microinches (4.6–5.6 micrometers). Thus, the present invention is particularly useful with stainless steel or aluminum substrates having a profile of no greater than 125 microinches (3.13 micrometers) and preferably less than 100 microinches (2.5 micrometers), and more preferably less than 50 microinches (1.25 microns) and even in the range of from 5 microinches to 30 microinches (0.13 to 0.76 microns), with cast aluminum being the exception in that the unroughened (as-cast) surface can have a higher surface profile as described above. For simplicity, the surface profiles disclosed herein are disclosed without reference to the designation Ra, although this is the proper designation for these profile determinations.

According to the present invention, the surface of a substrate is prepared by applying onto the surface a metallic layer which has been formed by thermal spraying a metal onto the surface of the substrate, the metal being galvanically compatible with the metal forming the surface of the substrate, i.e., aluminum onto aluminum and stainless steel onto stainless steel. The aluminum need not contain any silicon, in which case the aluminum coating on the substrate provides an excellent anchoring layer on the substrate for the non-stick overcoat layer, without the need for grit blasting, but preferably the aluminum contains up to 25 wt % Si. As the amount of silicon is increased from 0.1 wt % in the aluminum coating metal, the hardness of the resultant alloy also increases, to increase the scratch resistance of the non-stick resin coating eventually formed on the metallic layer. At least 0.10% by weight of the aluminum alloy is silicon. Preferably the aluminum layer is formed by thermally spraying aluminum containing from 0.10–20% by weight silicon onto the substrate surface. More preferably, the aluminum layer that is thermally sprayed contains from 5 or 10–23% by weight silicon. In the case of an aluminum substrate, the silicon content of the aluminum forming the coating on the substrate is preferably 0.10% by weight to 17% by weight. To insure the absence of galvanic action between the aluminum substrate and thermally sprayed aluminum, it is preferred that the two metals are galvanically compatible, which is obtained by having the silicon content of the metal coating within 6 wt % of the silicon content of the aluminum substrate, so as to eliminate any galvanic action occurring between the coating and the substrate which causes corrosion of the substrate and undermine the effectiveness of any non-stick coating applied over the metal coating on the substrate. For stamped aluminum substrates such as 3003 and 3004 which contain small amounts of silicon, the thermal spray layer is preferably an aluminum alloy composition containing from 0.10 to 6 wt % silicon. For cast aluminum substrates which contain as much as 12 wt % silicon, the thermal spray layer is preferably an aluminum alloy containing from 6 wt % silicon to 17 wt % silicon. Matching the composition of the thermal spray coating to the composition of the metal substrate is a key to eliminating bimetallic corrosion and had been found unexpectedly to provide for better adherence of nonstick coatings without the need for grit blasting. By matching is meant selecting a thermal spray composition that is the same or close to that of the metal substrate.

For stainless steel substrates, the stainless steels used for thermal spraying are the same stainless steel alloys described above for use as substrates. Here too the coating alloy composition should be the same as close to the composition of the substrate. The stainless steel alloys 304, 305, 309, 316, and 317 all appear to be galvanically compatible with one another. As in the case of the substrate stainless steels, austenitic stainless steel is the preferred stainless steel for use as the thermally sprayed coating.

The process for preparing a metal substrate used in this invention is generically referred to as thermal spraying and includes flame spraying, electric arc spraying or use of a plasma gun, and the spraying may be done in one or more passes (coatings) under the thermal spray. Powder spraying (flame or plasma) or arc spraying of metals in the form of wires is well known in the prior art and has been in commercial use for many years. FIG. 1 is a schematic of a typical arc spray gun (10) and metal substrate (11) being sprayed in accordance with the present invention. A suitable wire arc spray system is manufactured by Tafa, Inc. of Concord, N.H. as the 9000-series gun or the 8830/8835-series guns (with ArcJet™ attachment). Two wires (12) are fed from spools using gear driven feeders (not shown) for fine control of the metal deposition rate, through feed guides (13). They are electrically energized and precisely guided through openings (14) to an intersecting point (15). Once energized, each of the wires is surrounded by an ionized field. When the wires intersect, an electric arc (16) is established and maintained between the wires to melt the wires as they enter the arc. A nozzle (17) located directly behind the intersection point of the wires, blasts high velocity gas such as air (primary air) through the arc onto the molten wire tips producing a fine metal spray (18) of fine molten metal droplets aimed at and propelled onto the cookware substrate (11) to form the scratch and abrasion resistant layer (19). The spray has an included spray angle (20).

Figure 2:
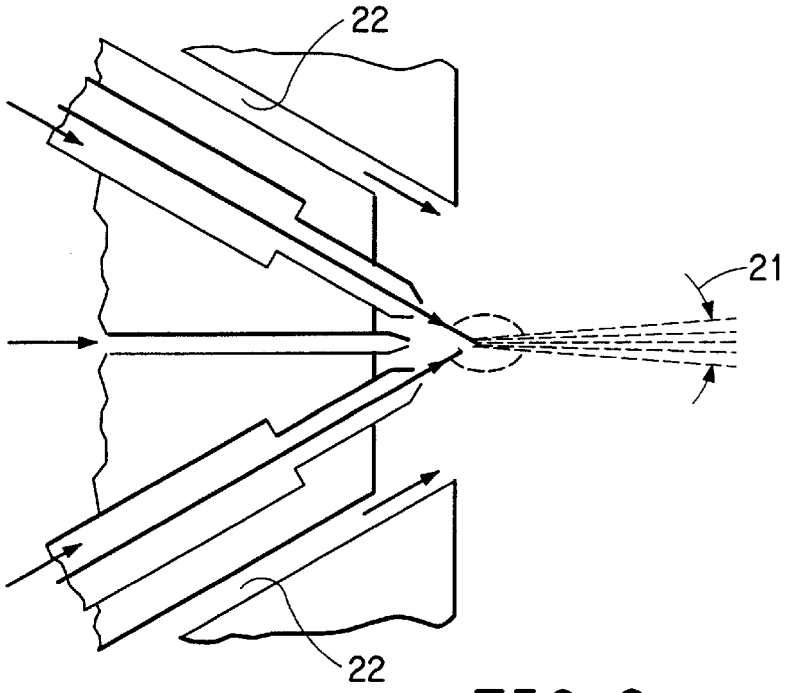
FIG. 2 is a schematic of another embodiment of the spray gun of FIG. 1.

In a preferred embodiment as shown in FIG. 2, the included spray angle (21) is made smaller than in FIG. 1, to improve the adhesion of the molten metal droplets to the substrate. This narrowing of the spray included angle in FIG. 2 is accomplished by circumferentially contacting the spray of molten metal droplets with a gas, such as air, under pressure, through an annulus (22) which directs the gas to conically envelop the spray and thereby compress it. While air might be expected to oxidize the molten droplets of aluminum forming the spray, to form aluminum oxide which does not adhere to smooth aluminum substrate, this apparently does not happen as indicated by the use of this secondary air providing improved adhesion of the metal droplets and thus the coating formed therefrom to the substrate. The secondary air also provides a smoother surface profile for the metallic layer. Notwithstanding that the molten droplets are contacted with two sources of air, primary air and secondary air, the molten droplets are not oxidized to prevent their adherence to the unroughened substrate. Equipment providing this spray angle control is available from Tafa as the 9000-series gun or the 8830/8835-series guns described above. In place of air used for either the primary air or secondary air supply, inert gases such as nitrogen or argon can be used, but with less economy than the use of air.

Settings for the wire arc spray equipment can be as follows:

Arc Current: 125 to 750–1000 amps depending on equipment manufacturer, model and roughness of deposition desired.

Arc Voltage: 25 to 35–50 volts

Spray distance to substrate: 4 to 36 inches, depending on equipment manufacturer, model and roughness of deposition required.

Atomizing air pressure (primary air): 50 to 85–150 psi, depending on equipment manufacturer, model and roughness of deposition required.

Secondary air pressure: 75–150 psi

Wire diameter: 1/16 inch (1.6 mm) diameter and larger diameters when high arc currents are used, e.g. 2 mm dia. wire when the current exceeds 400 amps In the case of production line requirements wherein the substrates to be coated have a line speed of at least 100 in/min (254 cm/min) and as high as 250 in/min (635 cm/min), and the substrates such as in the form of cookware are rotated beneath the source of the molten metal droplets, e.g. the arc spray gun, such rotation being on the order of 50 to 100 rpm, the application of the metal layer to the substrate is very dynamic. Exposure time to the spray is short and the article is moving both linearly and rotationally. Typically, the source of the spray of molten metal droplets cannot be positioned any closer than 6 to 20 inches (15.24 to 50.8 cm), which in the case of the droplets being aluminum increases the opportunity for oxidation to adversely affect adhesion to the substrate, but the adhesion nevertheless occurs. Often the source of the molten metal droplets can be no closer than 10 in (25.4 cm) to the substrate.

In the case of electric arc spraying of the molten metal on a production line basis, it has been found that the combination of high arc current and high primary air pressure is required to produce the desired metal coating on the unroughened surface of the substrate. Thus, arc currents of at least 350 amps and primary air pressures of at least 90 psi are desirable, preferably in further combination with the use of secondary air at a pressure of at least 75 psi preferably at least 90 psi. In each case, the gas can be air. Voltage also plays a role, depending on the "shine" of the substrate surface. A shiny surface provides a good adhesive substrate when the voltage is preferably in the range of 27 to 39 volts, along with an arc current of at least 500 amps. When the unroughened surface is nevertheless dull, such as for rolled surfaces, excellent results are obtained at an arc voltage of 32–34 volts, with the use of lower arc currents, e.g. 350–450 amps. These preferred conditions are applicable to aluminum and stainless steel substrates and to other metals as well. The primary and secondary air pressures can be the same when gas other than air is used.

The composition of the thermally sprayed coating layer is determined by the composition of the wires (12) fed to the arc spray gun. In some instances the composition of both wires selected is the same as the desired composition of the resultant scratch resistant layer i.e., two wires each being an aluminum alloy containing 12% wt Si are selected to produce a scratch resistant layer of aluminum alloy containing 12 wt % Si. In other instances, wires of different compositions are fed to the arc spray gun to produce a desired composition, i.e., one wire of aluminum alloy containing 12 wt % Si is co-fed with a second wire of aluminum alloy containing 6 wt % Si to produce a scratch resistant layer of aluminum alloy containing an equivalent average of 9 wt % aluminum.

The preferred spray coverage of the substrate should be a minimum of 50%, and preferably at least 70%, of the exposed surface to over 100% depending on the degree of scratch and abrasion resistance of the nonstick coating desired and overall aesthetics of the cooking surface. The term "over 100%" or "greater than 100%" refers to the application of an additional layer or overlay coating of metal or metal alloy onto the metal substrate, i.e. the substrate is subjected to multiple passes under the metal spray, which is accomplished on a production line by having multiple spray stations.

The preferred profile of the surface after spray application is in the range of 160 to 350 microinches (4.1 to 8.9 micrometers), with surface roughness of at least 250 microinches (5.1 micrometers) being preferred. The preference for surface roughness of no greater than 350 microinches arises from the disadvantage of having the metal coating surface being too rough, such that the non-stick coating applied thereto does not fill up all the "valleys" in the surface of the coating. When the valleys are too deep, the non-stick coating, even when applied as a liquid, as is usual for primer coatings, the liquid coating "bridges" the valleys, leaving small cavities existing between the non-stick coating and the metal coating. Permeation of cooking media through the non-stick coating fills these valleys with vapor, which upon heating, expands to cause blistering of the non-stick coating. In addition, when the valleys are too deep, the "peaks" in the topography of the metal coating are too high, which results in the peaks telegraphing into exposed surface of the non-stick coating, which then becomes susceptible to being abraded or cut away by kitchen utensils, to exposed the metal peaks in the non-stick layer, which detracts from both the appearance and non-stick character of the layer. The preferred surface roughness of the metal coating provides enough, but not too much topography for anchoring the non-stick overcoat. The surface topography represented by the preferred roughness range is also a measure of the amount of metal deposited on the substrate, i.e. as the amount of metal increases, so does the surface roughness. The surface roughness of 160 microinches requires sufficient metal to provide 100% coverage of the substrate surface.

The method of preparing the metal surface has applicability to aluminum and stainless substrates. With the present invention, prior grit blasting of aluminum and any other metal used for the substrate is eliminated, if desired, requiring only the removal of surface oils and dirt prior to application of the thermal sprayed metal. Typically, a surface profile of from 5 to 30 microinches (0.13 to 0.76 microns) after cleaning is adequate for good adhesion of the scratch resistant thermally sprayed layer. The thermal spray layer of this invention preferably confers a minimum hardness increase of at least 1.4×, and preferably at least 2×, over the baseline hardness of aluminum. Such increased hardness is not attainable by normal grit blasting of the bare aluminum.

Adhesion of the metal coating to the substrate is obtained by selecting the arc current and primary gas pressure generally within the parameters disclosed above to obtain the adhesion which is indicated by the superficial test of running a finger over the metal-coated substrate to see if powder comes off on the finger. The powder would be aluminum oxide which has not adhered to the substrate. As described above, good adhesion of the metal coating to the substrate is indicated by the scraping a knife across the metal surface; good adhesion is indicated by the scrapping knife not leaving any trail of the scraping motion. Good adhesion is also indicated by the use testing disclosed hereinafter, carried out on non-stick coated metal-coated substrates. The ability to get adequate adhesion will depend of the smoothness of the substrate. Generally, the greater the smoothness, the higher must the amperage creating the electric arc and the higher the primary air pressure must be. Use of the secondary air enables improved adhesion and a smoother surface profile to be obtained at a given amperage and primary air pressure. In any event, the amperage and primary air (gas) pressure are chosen, with or without the secondary air (gas) to be effective to obtain adhesion of the metal coating to the substrate.

Figure 3:
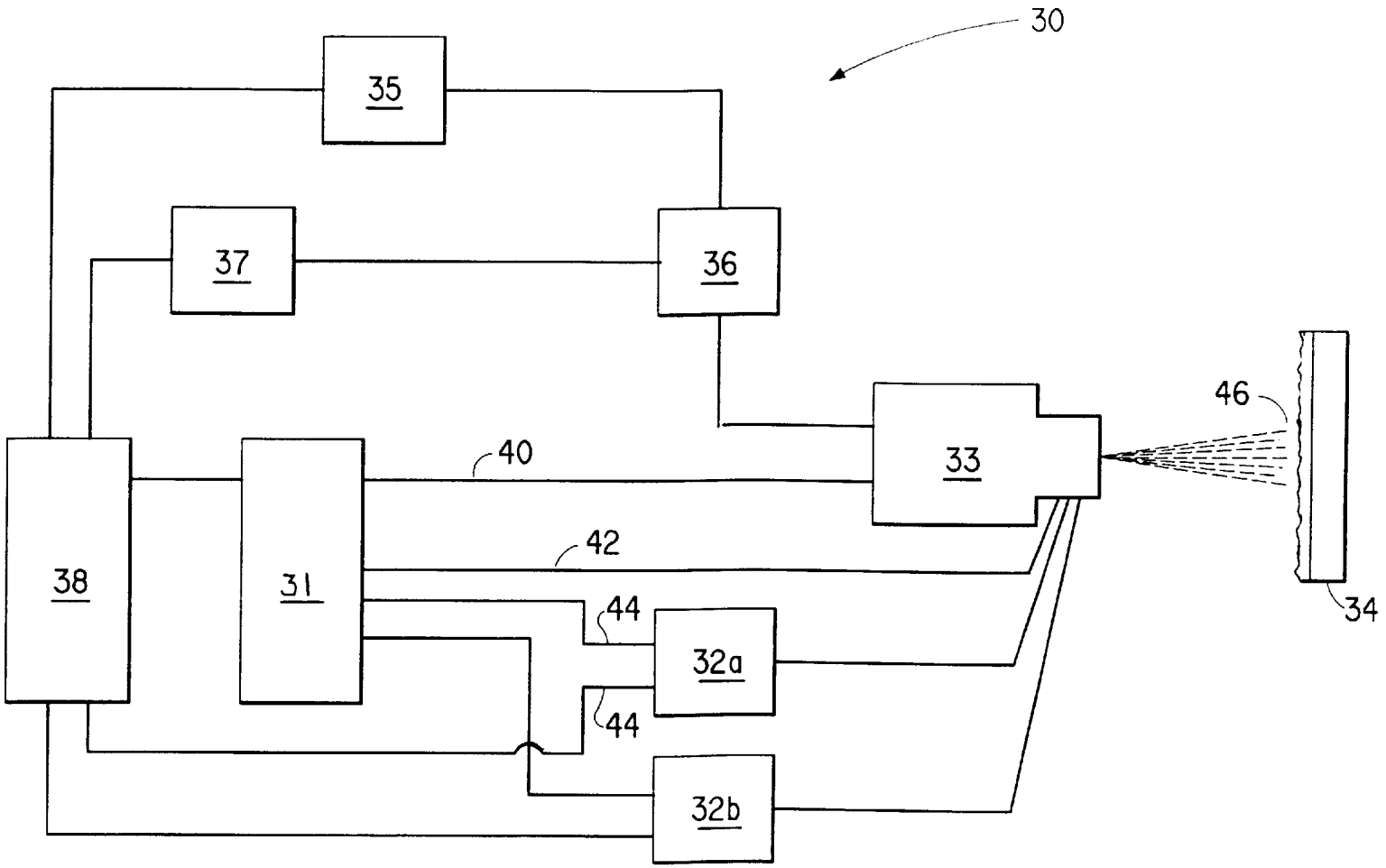
FIG. 3 is a schematic of a typical plasma jet gun applying a thermally sprayed powder layer to a metal substrate which has a thermally sprayed metallic layer.

In another embodiment, a surface of a metal substrate which is preferably aluminum is prepared for subsequent coating with a nonstick polymer resin by thermally applying onto the surface, which is unroughened, a metallic layer which is galvanically compatible with the metal substrate and subsequently applying a thermally sprayed powder layer, which is galvanically compatible with the metallic layer and the substrate, to produce the same surface profile as described hereinbefore for the electric arc spraying. The sprayed powder can be ceramic or metal or mixtures thereof such as oxides of (Al) and titanium (Ti) and metals of the same composition as can be used for the thermally applied metallic layer but selected to have increased hardness relative to the underlayer. Further provided is a coated unroughened substrate having both a galvanically compatible metal coating on said substrate surface formed by thermal spraying a metal (aluminum or stainless steel as described above) and a thermally sprayed powder layer which is galvanically compatible with the metallic layer. FIG. 3 is a schematic of a typical plasma spray coating system (30) for applying thermally sprayed powder. A suitable powder spray system is manufactured by Tafa, Inc. of Concord, N.H. as the PlazJet™ High Production Coating System. A gas module 31 provides hot ionized primary and secondary gas (plasma) via lines 40 and 42, respectively, as a heat source to melt metal or ceramic powders provided in dual powder feeders (32*a,* 32*b*). Carrier gas is fed to the powder feeders via lines 44 to feed the powders or mixture thereof to a plasma gun (33). Plasma systems provide controllable temperatures higher than the melting range of most substances. In the plasma process, a gas or a mixture of primary and secondary gases passes through an arc created between a coaxially aligned tungsten cathode (not shown) and an orifice in a copper anode (not shown). The gas partially ionizes during the heating process and produces a plasma. Injected into the plasma, the powder melts and the high velocity plasma stream propels it as a spray 46 onto a metal-coated substrate (34). The type of nozzle, arc current, gas mixture ratio, and gas flow rate control the heat content, temperature and velocity of the plasma stream. The arc operates on direct current from a rectifier-type power supply (35). High frequency unit (36) superimposes a high frequency voltage discharge on the power cables (not shown) of plasma gun (33) to start the arc. Water/cooling module (37) contains a pump to pressurize cooling water supplied to the gun. A central control console (38) regulates electric power of the arc, the plasma gas, and the flow of cooling water and the sequencing of these elements.

The primary plasma-forming gas is either nitrogen or argon. A secondary gas either hydrogen or helium, may be added to increase the heat content and velocity of the plasma. Argon may also be used as a carrier gas for the powders being fed to the coating system.

Typical setting for the plasma gun include:

Current: 300–500 amperes

Voltage: 280–480 volts

Primary gas flow: 400–500 standard cubic ft. per hour (scfh) (11–14 cubic meter per hour)

Secondary gas flow: 100–200 scfh (3–6 cubic meter per hour)

Carrier gas flow: 10–24 scfh (0.3–0.8 cubic meter per hour)

Powder feed screw speed: 75–300 rpm

The substrate surface prepared by thermal spraying a metallic layer according to this invention may be subsequently coated with a nonstick polymer coating consisting of one coat of nonstick resin as described in U.S. Pat. No. 4,443,574 (Coq) or two coats as described in U.S. Pat. No. 4,118,537 (Vary et al) or a three coat system as described in U.S. Pat. No. 4,351,882 (Concannon) using either powder, liquid (aqueous or solvent) or a hybrid system. The invention is suitable for applying nonstick polymer resins such as silicones or numerous fluoropolymer resins.

Suitable silicone nonstick resin coatings are described in U.S. Pat. Nos. 4,477,517 (Rummel), 4,028,339 (Merrill) and 4,262,043 (Wald) and are herein incorporated by reference.

Fluoropolymer nonstick coatings used as part of this invention may include a primer, one or more intermediate coatings, and/or a topcoat. Suitable primers, intermediate coats and topcoats suitable for use in this invention are described in the teachings of U.S. Pat. Nos. 4,087,394 (Concannon); 5,240,775 (Tannenbaum); 4,180,609 (Vassiliou); 4,118,537 (Vary & Vassiliou); 4,123,401 (Berghmans & Vary); 4,259,375 (Vassiliou), 5,562,991 (Tannenbaum), and 4,351,882 (Concannon) and 5,250,356 (Batzar); the disclosure of each is incorporated by reference.

One particularly useful fluoropolymer is polytetrafluoroethylene (PTFE) which provides the highest heat stability among the fluoropolymers. Optionally, the PTFE contains a small amount of comonomer modifier which improves film-forming capability during baking, such as perfluoroolefin, notably hexafluoropropylene (HFP) or perfluoro(alkyl vinyl) ether (PAVE), notably wherein the alkyl group contains 1–5 carbon atoms, with perfluoropropyl vinyl ether (PPVE) being preferred. The amount of modifier may be insufficient to confer melt-fabricability to the PTFE, generally no more than about 0.5 mole %. The PTFE, can have a single melt viscosity, usually about $1\times10^9$ Pa.s, but, if desired, a mixture comprising PTFE's having different melt viscosities can be used to form the fluoropolymer component.

In one aspect of this invention, the fluoropolymer component, is melt fabricable fluoropolymer, either blended with the PTFE, or in place thereof. Examples of such melt-fabricable fluoropolymers include tetrafluoroethylene (TFE) copolymers with one or more of the comonomers as described above for the modified PTFE but having sufficient comonomer content to reduce the melting point significantly below that of PTFE. Commonly available melt-fabricable TFE copolymers include FEP (TFE/HFP copolymer) and PFA (TFE/PAVE copolymer), notably TFE/PPVE copolymer. The molecular weight of the melt-fabricable tetrafluoroethylene copolymers is sufficient to be film-forming and be able to sustain a molded shape so as to have integrity in the primer application. Typically, the melt viscosity of FEP and PFA will be at least about $1\times10^2$ Pa.s and may range to about $60–10\times10^3$ Pa.s as determined at 372° C. according to ASTM D-1238.

The fluoropolymer components used in this invention may be applied as aqueous dispersions, or solvent based coatings or as powders. Well known techniques include (1) spray application using a conventional atomization process, (2) roller coating using horizontal transfer rolls to mechanically transfer coatings onto flat disks later formed into cookware shapes, (3) coil coating using horizontal transfer rolls for transfer of coatings onto continuous rolls of sheet metal in coil form, (4) curtain coating wherein flat metal disks or sheets which are conveyed through a vertical curtain or stream of polymer resin and (5) powder coating techniques using powder alone or a combination of liquid and powder coatings, for example by electrostatic spraying.

To apply a conventional three layer fluoropolymer coating . . . primer, intermediate, topcoat . . . commercial conventional or high volume low pressure conventional spray equipment may be used. Typical atomizing pressure ranges for conventional and HVLP setups are between 40 and 60 psi and 6 to 10 psi respectively with spray pot pressures to be used as needed to reliably transfer the coating to the spray gun. Typical setups require two spray guns each for primer and intermediate coat application and one gun for the topcoat. Typical dry film thickness are 0.1 to 0.6 mils (2.5 to 1 5 micrometers) for the primer, 0.3 to 0.8 mils (7.6 to 20 micrometers) for the intermediate coat and 0.3 to 0.4 mils (7.6–10 micrometers) for the topcoat. Typically the primer is air dried first and the two remaining coats are applied one over the other, wet on wet. However, in some cases all coatings are applied wet on wet and then dried. The nonstick coated cookware is cured in an oven in which the speed and temperature are controlled to achieve typical baking conditions as well known in the art.

Unroughened substrates used in this invention which have been prepared by thermally spraying one or more metallic layers onto the substrate and overcoated with a nonstick coating are smooth and hard and have a surface profile which is preferably less than 50 microinches (1.25 micrometers) to promote greater durability, although a surface smoothness of less than 90 or 125 microinches (3.2 micrometers) is useful. Substrates of this invention which have been prepared by thermally spraying one or more metallic layers optionally with a thermally sprayed powder and overcoated with a nonstick coating have a similar smooth surface and increased durability by virtue of the increased hardness of the layer of thermally sprayed powder, such layer being of increased hardness over the thermally sprayed underlayer.

Substrates which have been prepared by thermally spraying with a metal layer of this invention and subsequently coated with a nonstick polymer resin are suitable for use as cookers, fryers, roasters, bakeware, top of the range cookware and the like. Other possible uses of coated substrates include saws, iron soles, hot plates, shoe molds, snow shovels and plows, ship bottoms, chutes, conveyors, dies, tools, reactor vessels, industrial containers and the like.

Test Methods

Atlas Cell Test

This test involves exposure of the coated interior surface of a cooking vessel to a boiling 5% salt solution. It is run for 120 continuous hours to test for corrosion of the base metal as well as for bimetallic coupling (galvanic compatibility). The Atlas Cell has a built in reflux condenser so that the concentration of the salt solution is maintained constant over the test period.

Special Blister Corrosion Test (SBT)

This test involves simmering salt water for an hour followed by simmering commercially available tomato sauce with added salt for 2 hours while water is constantly added to maintain the level in the pan. Following the simmer cycle, the pan is rinsed with water and allowed to soak for 21 hours in a mild dish washing detergent solution. This cycle is repeated 3 times and the pans examined.

British Standard Blister Test (BS 7069)

This test involves the exposure of the coated interior surface of a cooking vessel to a boiling 10% salt solution. The surface of a cooking vessel is first examined visually for any defects. The vessel is filled with salt solution to a level of more than half-way up the wall. The solution is boiled for 24 hours during which time water is added, as required to maintain the liquid level within a band of 15 mm wide. The 24 hour period may be continuous or may comprise four periods of 6 hours. After boiling, the vessel is washed to remove any adhering salt and immediately examined visually for any defects not present at the first examination. The test is repeated using dishwasher detergent in place of salt and carrying out the test at 70±5° C.

The coated substrate passes each of these three corrosion tests when no evidence of blistering is visible in the coating. The blistering would be evidence of galvanic corrosion occurring beneath the surface of the non-stick coating. The absence of blistering indicates galvanic compatibility between the metal substrate and the thermally applied metal layer(s).

Commercial Kitchen Use

Four weeks continuous use in a commercial kitchen where metal utensils were used on the cooking surface. Cooking was done at very high heat and in some cases, plastic handles of the test pans were broken and required replacement.

Accelerated In-Home Abuse Test (AIHAT)

The AIHAT test involves a series of high heat (246°–274° C.) cooking cycles using common household metal cooking utensils (fork, spatula, whisk, knife). The invention provides the best overall scratch and mar resistance when compared to prior commercial cookware coating systems.

Procedure 1—Eggs

A. Pour whole egg into center of pan set at 260°274° C. Fry egg 3 minutes. Flip with metal spatula. Fry other side for 1 minute. Flip egg 5 additional times. Cut egg into 9 equal pieces with knife. Record temperature. Remove egg. (All flipping with spatula should be done with a single stroke.)

B. Use 120 cc 1B mixture (described below). Pour into frypan. Scramble with tines of 4-tined fork using circular motion. 60 cycles. Maintain 90 degree angle of fork to frypan. Remove egg from pan with high pressure hot water.

Procedure 2-Hamburger and Tomato Sauce

A. Set pan to 246°–260° C. Fry thawed ½ hamburger 3 minutes. Flip with metal spatula. Cook 1 minute. Set hamburger to side of pan. Stir with metal fork on coating surface in "Z" motion ten times. Reverse "Z" 10 times. 90 degree angle of fork.

B. Add 180 cc Tomato Sauce 2B (described below). Cook to reduce volume to ⅓ stirring with whisk edges, using zigzag motion 50 times.

A contact pyrometer is used to measure the temperature at a point midway between the center of the pan and the side wall where the handle is attached.

Two dishwasher cycles are carried out with 10 cycles of cooking. The first dishwashing is done during the 10 cooking cycles and the second at the end of the 10 cooking cycles. Then the AIHAT ratings are made.

1B Mixture 470 cc water 2 dozen eggs 120 g salt
Mix in blender.
2B Tomato Sauce
945 cc sauce
120 g salt
Dilute with water to 3.8 liter of preparation.
Mix thoroughly.
Ratings: Numerical basis rating 0–10. 10 best. Based on judgment of experienced tester.

EXAMPLE 1

A series of wire materials and atomizing gas combinations were investigated as shown in Table 1 to reactively harden wire-arc sprayed coatings. Microhardness testing was carried out (at 50 gm load) on thick coatings (greater than 100% coverage) sprayed onto flat 1"×3" (2.5 cm to 7.6 cm) coupons cut from an aluminum metal substrate having a surface profile of less than 50 microinches (1.25 micrometers).

TABLE 1

| Wire Material | Atomizing Gas | Microhardness (vhn50) | Comments |
|---|---|---|---|
| Pure Al | N/A | 49.68 + −3.95 | Baseline hardness of pure Al wire material |
| Al | Ar | 59.42 + −7.71 | 19.6% increase in VHN over baseline |
| Al | N2 | 64.26 + −6.03 | 29.3% increase in VHN over baseline |
| Al | Air | — | — |
| Al | Air + $O_2$ (50/50) | 67.45 + −5.46 | 35.7% increase in VHN over baseline |
| Al | Air + $O_2$ (60/40) | 56.7 + −8.53 | 14% increase in VHN over baseline |
| Al | $O_2$ | ~70 | Hardest "reactively sprayed" Al coating |
| Al-12% Si | Air | 146.4 + −12.46 | ~3 x increase in VHN over baseline |
| Al/304 SS | Air | 249.6 + −38.83 | 2 dissimilar wires used. Hardest coating. 5x VHN of baseline |

From the data in Table 1, three combinations as shown in Table 2 were selected for further investigation. On the basis of the above material/microhardness data the following fry pans formed from aluminum substrate samples were sprayed onto the interior cooking surface of the frypan:

TABLE 2

| | |
|---|---|
| Al-12%Si: | 7 Pans @ 60–80% Coverage (No Grit Blast) |
| Al/304-SS Co-spray: | 7 Pans @ 60–80% Coverage (No Grit Blast) |

The wire-arc spray parameters developed and used to coat the interior of the fry pans for testing are listed in Table 3.

TABLE 3

| Wire-Arc Spray System: | Tafa, Inc. 9000-Series (s. ArcJet attachment) |
|---|---|
| Arc Current: | ~125 A |
| Arc Voltage: | ~32 V |
| Spray Distance: | 4 inches |
| Atomizing Gas: | Air (from high pressure cylinders) |
| Air Supply Pressure: | 150 psi |
| Atomizing Air Pressure: | 50 psi |
| ArcJet Air Pressure: | 50 psi |
| Velocity dX/dt: | 85% |
| Step Size: | 1/2 |
| No. Cycles: | 2 |
| Substrates: | Stamped Al 3003 Alloy Frying Pans |
| Surface Preparation: | <100% Coverage: Alcohol Clean only |
| Cooling: | None |
| Wire(s): | 1/16 AE Al-12%Si (Tafa, Inc. Type 01A) |
| | 1/16 AE 80/20 Ni Cr (Tafa, Inc. Type 06C) |
| | 1/16 AE 304-SS (Tafa, Inc. Type 80T) |

The following preliminary conclusions were derived from these tests:

The hardness of wire-arc sprayed Al was increased by up to 1.2× using $O_2$ as the atomizing gas.

Adherent Al, Al-Si, and Al+Stainless Steel coatings of less than 100% coverage were produced without the need to grit blast the substrate surface.

Coatings with a microhardness of ~250 VHN50 were obtained by co-spraying Al and 304-SS wires.

The sample pans having an interior thermally sprayed metallic layer as described in Table 2 were subsequently coated with a 3 coat nonstick system comprising a primer, and intermediate coat and a topcoat at the following dry film thicknesses: 0.3 mils (7.6 micrometers) primer, 0.7 (18 micrometers) mils intermediate coat and 0.3 mils (7.6 micrometers) topcoat. The coating was cured 15 in an oven as follows: 5 minutes at greater than 800° F. (427° C.) with a peak temperature of 815° F. (435° C.). Suitable primers, intermediate and topcoats are described in the teachings of U.S. Pat. Nos. 4,037,394 (Concannon); 5,240,775 and 5,230,961 (both to Tannenbaum); 4,180,609 (Vassiliou); 4,118,537 (Vary and Vassiliou); 4,123,401 (Berghmans and Vary); 4,259,375 (Vassiliou) and 4,351,882 (Concannon) and 5,250,356 (Batzar); the disclosure of each which is incorporated by reference.

The test pans with the metallic layer and overcoated with nonstick polymer resin were subjected to a series of corrosion and abusive cooking tests as described above. The results are as follows:

Commercial Kitchen Use

Frypans (Al-12% Si-coated) were subjected to commercial kitchen use. After 4 weeks continuous use in a commercial kitchen using metal utensils, three was no visible damage to the interior surface—slight visible scratches. The integrity of the coating and the nonstick coating performance were judged excellent.

Accelerated In-Home Abuse Test (AIHAT)

Frypans (Al-12% Si-coated) were subjected to AIHAT tests, with the result being light visible effect or scratches in the interior of the tested frypans after the normal 10 cycles. Some of the pans were subjected to an additional 10 cycles and there was no visible deterioration.

All of the coated frypans failed the blister tests, i.e., blistered during such tests, indicating galvanic incompatibility of the metal coating with the 3003 aluminum substrate.

EXAMPLE 2

As shown in Table 6, listed are 16 examples of a variety of thermally sprayed layers applied to metal frypans (10 inch diameter) of varying substrate composition at varying application conditions using a wire arc spray system 8835 (with ArcJet™ attachment) manufactured by Tafa, Inc. of Concord, N.H.

Metallic Substrate Composition
- Rolled/Stamped Aluminum 3003 (Al-1% Mn-Cu)
- Cast Aluminum (Al-12% Si)
- 304 Stainless Steel Wire Alloys (alone or in combination):
- Al-6% Si
- Al- 12% Si
- Al 3003 (Al-1% Mn-Cu)
- Al 3004 (Al-1% Mn-1% Mg)
- Al 1350 (99.5% Al)
- 309 Stainless steel Wire Size (outside diameter): 1.6–2.0 mm
Current: 350–650 amperes DC
Voltage: 32–37 volts
Line Speed: 110–200 in/min (279–508 cm/min)

As previously described herein, two wires are fed to the electric arc spraying equipment and energized. In Table 6, if a single alloy composition is listed, both wires are of this composition. If two alloys are listed, one wire is of a first composition, and the other wire is of the second composition. A nozzle directly behind the intersection point of the wires provides primary air at a pressure of 110 psi (except for Ex. 2–15 in which the primary air pressure is 70 psi) to produce a fine metal spray. Secondary air at a pressure of 94 psi (except for Ex. 2–15 in which the secondary air pressure is 80 psi) is provided through an annulus which envelops and compresses the spray. Voltage supply, current, and wire size are varied as set forth in Table 6. Production line conditions are simulated in that the pans were moving linearly beneath the source of metal spray at a rate of between 110–200 in/min (279–508 cm/min) while rotating at a speed of 100 rpm at distances from the spray varying between 12 and 20 in (30.5 and 51 cm). The surface roughness of the frypans varies from 14–125 microinches (0.4 to 3.2 micrometers) as well as the surface finish (shiny/dull), however the frypan surfaces are unroughened and not pretreated. Arc current and voltage are also varied. Some pans are subjected to a single pass under the metal spray and some to 2 passes.

A number of the pans are tested for microhardness (at 50 gm load) and compared to the base unroughened, unsprayed metal substrate. Pans that are electric arc sprayed have an increased hardness of at least 1.4× that of unsprayed, unroughened pans, such hardness not attainable by grit blasting alone.

TABLE 6

| EXAMPLE | 2-1 | 2-2 | 2-3 | 2-4 | 2-5 | 2-6 | 2-7 |
|---|---|---|---|---|---|---|---|
| PAN TYPE | | | | | | | |
| Rolled/Stamped (Al 3003) | X | X | X | X | X | X | X |
| Cast Al (Al-12Si) | | | | | | | |
| Stainless Steel (304) | | | | | | | |
| Surface Finish | Dull | Dull | Dull | Dull | Dull | Dull | Dull |
| Original Surface Profile (Ra) (Microinches) | 20 | 20 | 20 | 20 | 20 | 20 | 20 |
| Wire Type | Al-12Si | Al-12Si | Al-6Si | Al 3003 | Al 1350 | Al 1350 | Al-6Si/ Al 1350 |
| Arc Load Volts (Volts DC) | 32 | 32 | 32 | 32 | 34 | 34 | 34 |
| AMPS (AMPS DC) | 500 | 500 | 400 | 400 | 400 | 400 | 400 |
| Spray Distance (inches) | 20 | 20 | 20 | 20 | 20 | 20 | 20 |
| Line Speed (inches/minute) | 200 | 200 | 110 | 200 | 110 | 110 | 110 |
| Pan Rotational Rate (RPM) | 100 | 100 | 100 | 100 | 100 | 100 | 100 |
| No. of Passes | 1 | 2 | 1 | 2 | 1 | 2 | 1 |
| Alloy Deposition (Grams) | 0.8 | 2.0 | 1.6 | 2.2 | 1.8 | 3.6 | 1.2 |
| Surface Roughness (Ra) (Microinches) | 177 | 340 | 259 | 296 | 289 | 269 | 211 |

| EXAMPLE | 2-8 | 2-9 | 2-10 | 2-11 | 2-12 | 2-13 | 2-14 | 2-15 | 2-16 |
|---|---|---|---|---|---|---|---|---|---|
| PAN TYPE | | | | | | | | | |
| Rolled/Stamped (Al 3003) | X | X | | | | | | X | |
| Cast Al (Al-12Si) | | | X | X | X | X | X | | |
| Stainless Steel (304) | | | | | | | | | X |
| Surf Finish | Dull | Dull | Dull | Dull | Shiny | Shiny | Dull | Dull | Shiny |
| Original Surface Profile (Ra) (Microinches) | 20 | 20 | 43 | 43 | 14 | 125 | * | 20 | |
| Wire Type | Al-6Si/ Al 3003 | Al-3004* | Al-6Si/ Al 1350 | Al 3003 | Al-6Si | Al-6Si | Al-6Si | Al-1350** | 3099SS |
| Arc Load Volts (Volts DC) | 32 | 30 | 34 | 32 | 37 | 37 | 37 | 34 | 37 |
| AMPS (AMPS DC) | 400 | 350 | 400 | 400 | 600 | 600 | 550 | 650 | 600 |
| Spray Distance (inches) | 20 | 12 | 20 | 20 | 20 | 20 | 20 | 20 | 20 |
| Line Speed (inches/minute) | 110 | 150 | 110 | 200 | 110 | 110 | 150 | 200 | 110 |
| Pan Rotational Rate (RPM) | 100 | 100 | 100 | 100 | 100 | 100 | 100 | 100 | 100 |
| No. of Passes | 1 | 1 | 1 | 2 | 1 | 1 | 2 | 2 | 1 |
| Alloy Deposition (Grams) | 1.6 | 2.0 | 1.0 | 1.2 | 1.0 | 1.0 | 2.7 | 5.8 | 2.0 |
| Surface Roughness (Ra) (Microinches) | 285 | 195 | 198 | 270 | 199 | 236 | * | 396 | 300 |

*Curved surface; cannot measure roughness.
**Primary Air Pressure = 70; Secondary Air Pressure = 80

The test pans from Examples 2-1 to 2-16 are overcoated with nonstick polymer resin similar to the multilayer system described in U.S. Pat. No. 5,250,356 having a primer of PTFE-PFA reinforced with $Al_2O_3$, a midcoat of PTFE-PFA reinforced with $Al_2O_3$, and a top coat of PTFE having a total coating thickness of about 1.5 mils (38 micrometers).

Examples 2-1, 2-2, 2-3 are subjected to AIHAT, Atlas Cell, SBT and British Blister Test. All three examples passed the AIHAT test. Of these three Examples, only Example 2–3 successfully passes the three corrosion tests as shown by the absence of blistering, indicating the desirability of selecting a thermal spray coating which is galvanically compatible with the substrate as is the case for Examples 2–5 to 9, 2–15 and 2–16.

EXAMPLE 3

Unroughened, frypans of rolled/stamped Aluminum 3003 (Al-1% Mn-Cu) having a diameter of 10 inches are thermally sprayed with using a wire arc spray system 8835 (with ArcJet™ attachment) manufactured by Tafa, Inc. with Al 3003 with application conditions similar to Example 24 and oversprayed with a thermal spray ceramic or metal powder layer using a PlazJet™ plasma coating system also manufactured by Tafa, Inc. having the effect of increasing the hardness of the substrate and thus the nonstick resin coating applied thereto.

Unroughened, cast frypans of Aluminum (Al-12% Si) having a diameter of 10 inches are thermally sprayed with using a wire arc spray system 8835 (with ArcJet™ attachment) manufactured by Tafa, Inc. with Al-12Si (with application conditions similar to Example 2–4 and oversprayed with a thermal spray ceramic or metal powder layer using a PlazJet™ plasma coating system also manufactured by Tafa, Inc. having the effect of increasing the hardness of the substrate and thus the nonstick resin coating applied thereto.

Powders

Al-3% Ti=97% $Al_2O_3$-3% Ti

Al-13%Ti=87% $Al_2O_3$-13% Ti

Blend (50/50) Al-3% Ti/Al-12% Si (blended prior to feeding)

Al-12% Si alloy powder

Specific combinations and application conditions are listed in Table 7.

Powders that can be used preferably contain 60–100% $Al_2O_3$ and 0–40 wt % $TiO_2$, to total 100%. Preferred mixtures contain 85–98 wt $Al_2O_3$ and 2–15 wt % $TiO_2$, to total 100%.

The plasma coating equipment is in a configuration as previously described herein. Nitrogen is used as the primary gas, hydrogen as the secondary gas, and argon as a carrier gas. The water flow rate is 7.5 gpm. Dual powder feeders are used having a screw pitch of 4 flights per inch and a screw diameter of ⅜ inch. Voltage supply, current, gas flow rates, feed screw speed are varied as set forth in Table 7. The substrate (frypan) is located 6 inches from the spray gun. Production line conditions are simulated in that the pans are moved linearly beneath the source of metal spray at a rate indicated in the table while rotating at a speed of 100 rpm. The spray is incremented in steps of 0.315 inches. Four passes are used to spray the pans' surfaces. Amount of deposition of thermal spray powder is indicated in the table. The surface profile of each pan is determined.

TABLE 7

| EXAMPLE | 3-1 | 3-2 | 3-3 | 3-4 | 3-5 | 3-6 |
|---|---|---|---|---|---|---|
| PAN TYPE | | | | | | |
| Rolled (Al3003) | X | | | | X | X |
| Cast Al (Al-12Si) | | X | X | X | | |
| ArcJet Coating | | | | | | |
| Al3003 | X | X | | | | X |
| Al-12Si | | | X | X | | |
| Al-6Si | | | | | X | |
| Ceramic* Powder | Al-3Ti | Al-3Ti | Al-12Si | Al-13Ti | Al-3Ti | 50(Al-3Ti)/ 50(Al-12Si) |
| Voltage Supply (DC Volts) | 373 | 373 | 300 | 373 | 373 | 354 |
| Amps (DC Amps) | 500 | 500 | 350 | 500 | 500 | 500 |
| $N_2$ Set Point (Scfh) | 450 | 450 | 300 | 465 | 450 | 400 |
| $H_2$ Set Point (Scfh) | 150 | 150 | — | 180 | 150 | 110 |
| Feed Screen Speed (RPM) | 100/100 | 100/100 | 100/100 | 200/200 | 120/120 | 75/75 |
| Ar Carrier Flow (Scfh) | 12/12 | 12/12 | 15/15 | 15/15 | 12/12 | 12/12 |
| Line Speed (inches/minute) | 200 | 200 | 200 | 200 | 200 | 472 |
| Ceramic Deposition (Grams) | 3.0 | 2.2 | 12.0 | 16.4 | 11.4 | 2.4 |
| Surf. Roughness (Microinches) | 207 | 217 | 439 | 344 | 278 | 276 |

*Al-3Ti = 97$Al_2O_3$-3$TiO_2$
Al-13Ti = 87$Al_2O_3$-13$TiO_2$

The pans are tested for microhardness (at 50 gin load) and compared to the base unroughened, unsprayed metal substrate. Pans that are electric arc sprayed with subsequent thermal spray powder coating have an increased hardness of at least 21 that of unsprayed, unroughened pans, such hardness not attainable by grit blasting alone.

The test pan from Example 3-1 is overcoated with nonstick polymer resin were subjected to a series of corrosion and abusive cooking tests. The nonstick polymer applied is similar to the multilayer system described in U.S. Pat. No. 5,250,356 having a primer of PTFE-PFA reinforced with $Al_2O_3$, a midcoat of PTFE-PFA reinforced with $Al_2O_3$, and a top coat of PTFE having a total coating thickness of about 1.5 mils (38 micrometers).

Example 3-1 is subjected to AIHAT and successfully passes this abusive cooking test. Galvanic compatibility is indicated by the preceding Examples. The ceramic powder has not presented a galvanic corrosion problem.

What is claimed is:

1. A method of preparing a surface of an unroughened aluminum or stainless steel substrate for subsequent coating with a nonstick polymer resin comprising applying onto said unroughened surface a metallic layer by feeding a pair of wires of a metal, which is aluminum containing up to 50% by weight of silicon when said surface is aluminum and which is stainless steel when said surface is stainless steel, into an electric arc to form molten metal from said wires in said arc and contacting said molten metal with gas flowing through said arc to convert said molten metal to a spray of molten metal droplets having an included spray angle, aimed at said surface to form said metallic layer thereon, wherein the current creating said arc is at least 350 amps and up to 1000 amps.

2. The method of claim 1 wherein said metal is galvanically compatible with said surface.

3. The method of claim 1 wherein the silicon content of said aluminum is up to 25 wt %.

4. The method of claim 1 wherein the surface is clean and has an average surface profile of less than 2.5 micrometers prior to applying said metallic layer.

5. The method of claim 1 wherein said metallic layer has a surface profile of 4.1 to 8.9 micrometers.

6. The method of claim 1 wherein said substrate is in the form of cookware having an inside cooking surface which is the surface on which said metallic layer is applied.

7. The method of claim 8 wherein said gas is applied at a pressure of at least 90 psi.

8. The method of claim 1 and additionally circumferentially contacting said spray with gas to narrow the included angle of said spray, thereby improving adhesion of said metal droplets to said substrate to form said coating.

9. The method of claim 8 wherein said gas narrowing said included angle is applied at a pressure of at least 75 psi.

10. The method of claim 1 wherein said electric arc is positioned at least 6 in. (15.24 cm) from said substrate.

11. The method of claim 1 and additionally plasma spray coating said metallic layer with hardening powder.

12. The method of claim 1 wherein said surface is aluminum and said metal being sprayed is aluminum and both contain silicon.

13. The method of claim 12 wherein the silicon content of said aluminum surface is 0.1 to 17 wt % and the silicon content of said aluminum metal being sprayed is 0.1 to 25 wt %.

14. The method of claim 12 wherein the silicon content of said aluminum metal being sprayed is within 6 wt % of the silicon content of said aluminum surface.

15. The method of claim 1 wherein said substrate surface is made by casting or by rolling.

16. The method of claim 1 wherein said silicon content is at least 0.1 wt %.

17. The method of claim 16 wherein the silicon content of said aluminum metal being sprayed is 5 to 23 wt %.

18. A method of coating aluminum or stainless steel cookware on the inside cooking surface thereof comprising:

a. cleaning said surface, said surface being unroughened, b. applying a metallic layer to said cleaned unroughened surface by electric arc spraying aluminum containing up to 50% by weight of silicon when said surface is aluminum and stainless steel when said surface is stainless steel at a current from 350 to 1000 amps, and c. applying at least one nonstick polymer resin coating to the metallic layer.

19. The method of claim 18 wherein the nonstick polymer resin coating is applied by at least one of a powder coating and a liquid dispersion coating, and said coating is heated to a temperature sufficient to cure said coating.

20. The method of claim 19 wherein said nonstick polymer is a fluoropolymer.

21. The method of claim 18 wherein said at least one non-stick polymer resin coating includes a primer layer and a topcoat, the polymer resin in said topcoat being a fluoropolymer resin selected from the group consisting essentially of polytetrafluoroethylene, tetrafluoroethylene/perfluoro(alkyl vinyl ether) copolymer, tetrafluoroethylene/hexafluoropropylene copolymer, and mixtures thereof.

22. The method of claim 18 wherein said silicon content is at least 0.1 wt %.

* * * * *

UNITED STATES PATENT AND TRADEMARK OFFICE

CERTIFICATE OF CORRECTION

PATENT NO : 6,123,999

DATED : September 26, 2000

INVENTOR(S) : Felix et al.

It is certified that error appears in the above-identified patent and that said Letters Patent is hereby corrected as shown below:

Claim 7, line 1, change "8" to --1--.

Signed and Sealed this

First Day of May, 2001

*Attest:*

Nicholas P. Godici

NICHOLAS P. GODICI

*Attesting Officer*

*Acting Director of the United States Patent and Trademark Office*